United States Patent [19]

Bayles, Jr. et al.

[11] Patent Number: 5,062,975

[45] Date of Patent: Nov. 5, 1991

[54] FUNCTIONAL FLUID WITH BORATED EPOXIDES, CARBOXYLIC SOLUBILIZERS, ZINC SALTS, AND CALCIUM COMPLEXES

[75] Inventors: Frederick L. Bayles, Jr., Rocky River; Reed H. Walsh, Mentor; Craig D. Tipton, Perry, all of Ohio

[73] Assignee: The Lubrizol Corporation, Wickliffe, Ohio

[21] Appl. No.: 526,967

[22] Filed: May 22, 1990

Related U.S. Application Data

[63] Continuation of Ser. No. 831,021, Feb. 19, 1986, abandoned.

[51] Int. Cl.[5] ..... C10M 141/12

[52] U.S. Cl. ..... 252/33; 252/32.7 E; 252/33.2; 252/25; 252/49.6; 252/51.5 A; 252/75

[58] Field of Search ..... 252/51.5 A, 32.7 E, 252/33, 25, 33.2, 49.6, 75

[56] References Cited

U.S. PATENT DOCUMENTS

| | | | |
|---|---|---|---|
| 3,219,666 | 11/1965 | Norman et al. | 252/51.5 R |
| 3,933,659 | 1/1976 | Lyle et al. | 252/42.7 |
| 4,116,877 | 9/1978 | Outten et al. | 252/49.8 |
| 4,135,297 | 3/1984 | Forsberg | 252/34.7 |
| 4,263,150 | 4/1981 | Clason et al. | 252/32.7 E |
| 4,410,438 | 10/1983 | Horodysky | 252/49.6 |
| 4,435,297 | 3/1984 | Forsberg | 252/51.5 A |
| 4,698,169 | 10/1987 | Andress, Jr. et al. | 252/51.5 A |
| 4,822,507 | 4/1989 | Kanamori et al. | 252/51.5 A |

OTHER PUBLICATIONS

Smalheer and Smith, Lubricant Additives, 1967, pp. 4–6.

McGraw-Hill, Encyclopedia of Chemistry, 1982, pp. 1023–1024.

*Primary Examiner*—Prince E. Willis
*Assistant Examiner*—Jerry D. Johnson
*Attorney, Agent, or Firm*—James L. Cordek; Frederick D. Hunter; Joseph P. Fischer

[57] ABSTRACT

A multipurpose functional fluid is disclosed which is comprised of a major amount of a hydrocarbon oil and a minor amount, sufficient to improve characteristics of the fluid of a novel additive. The additive is comprised of a calcium salt complex, a group II metal dithiophosphate salt, a borated epoxide and a carboxylic solubilizer. The calcium salt is preferably in the form of an overbased calcium sulfonate salt, the antiwear agent is preferably in the form of a zinc dithiophosphate salt, the borated epoxide is preferably the reaction product of boric acid and a 16 carbon 1,2 epoxide and the carboxylic solubilizer is preferably in the form of a reaction product of an acylating agent containing a substituted hydrocarbyl-based substituent containing about 12 to 500 carbon atoms. Other components such as viscosity improvers and antifoaming agent are generally present in the fluid. The resulting fluid has improved low temperature fluidity and filterability, improved EP/antiwear performance, excellent friction improving properties, antichatter capability as well as being capable of passing hydraulic/transmission tests, power steering and brake capacity tests. These features are maintained simultaneously without harming other desirable performance characteristics of the fluid. The EP/antiwear performance characteristics are maintained concurrently with the anticorrosion characteristics and transmission performance capabilities. The improved water tolerance is maintained concurrently with the improved EP performance characteristics.

11 Claims, No Drawings

FUNCTIONAL FLUID WITH BORATED EPOXIDES, CARBOXYLIC SOLUBILIZERS, ZINC SALTS, AND CALCIUM COMPLEXES

This is a continuation of copending application Ser. No. 831,021, filed on Feb. 19, 1986, now abandoned.

BACKGROUND OF THE INVENTION

A functional fluid is a term which encompasses a variety of fluids including but not limited to tractor fluids, automatic transmission fluids, manual transmission fluids, hydraulic fluids, power steering fluids, fluids related to power train components and fluids which have the ability to act in various different capacities. It should be noted that within each of these fluids such as, for example, automatic transmission fluids, there are a variety of different types of fluids due to the various transmissions having different designs which have led to the need for fluids of markedly different functional characteristics. One type of functional fluid is generally known as a tractor fluid which can be used in connection with various types of tractor equipment in order to provide for the operation of the transmission, gears, bearings, hydraulics, power steering, mechanical power take off and oil immersed brakes of the tractor.

The components included within a functional fluid such as a tractor fluid must be carefully chosen so that the final resulting fluid composition will provide all the necessary characteristics required and pass a variety of different types of tests. In general a tractor fluid must act as a lubricant, a power transfer means and a heat transfer means.

Tractor fluids have a number of important specific characteristics which provide for their ability to operate within tractor equipment. Such characteristics include the ability to provide proper frictional properties for preventing wet brake chatter of oil immersed brakes while simultaneously providing the ability to actuate wet brakes and provide power take-off (PTO) clutch performance. A tractor fluid must provide sufficient antiwear and extreme pressure properties as well as water tolerance/filterability capabilities.

The extreme pressure (EP) properties of tractor fluids are demonstrated by the ability of the fluid to pass a spiral bevel test as well as a straight spur gear test. The tractor fluid must pass wet brake chatter tests as well as provide adequate wet brake capacity when used in oil immersed disk brakes which are comprised of a bronze, graphitic compositions and asbestos. The tractor fluid must demonstrate its ability to provide friction retention for power shift transmission clutches such as those clutches which include graphitic and bronze clutches.

U.S. Pat. No. 4,410,438 discloses a lubricant and liquid fuel composition which includes borated epoxides which are indicated as being useful in fluids such as heat exchange fluids, transmission fluids, and hydraulic fluids.

U.S. Pat. No. 3,933,659 discloses a functional fluid for lubricating oil compositions which is comprised of a major amount of an oil of lubricating viscosity and an effective amount of an additive. The additive includes effective amounts of an alkaline succinimide, a group II metal salt of a dihydrocarbyldithiophosphoric acid, a basic sulfurized alkaline earth metal alkyl phenate and a component which is a fatty acid ester, fatty acid amide or fatty acid amine or mixtures thereof. The patent indicates that the lubricating compositions are useful as functional fluids in systems requiring fluid coupling, hydraulic fluid and/or lubrication of relatively moving parts. The lubricating compositions are indicated as being useful as the functional fluid in automatic transmissions and particularly in the automatic transmissions of passenger automobiles.

U.S. Pat. No. 4,116,877 discloses an elastomer compatible seal swell additive. The additive may be used in connection with automatic transmission, power transmission fluids and hydraulic steering fluids. The fluid is a mineral lubricating base oil which includes an oil-soluble bis(hydrocarbyl) phosphite ester and an oil-soluble hydrocarbyl substituted phenol wherein a specific weight ratio is maintained with respect to the phosphite and phenol. The patent indicates that the inclusion of these particular additive compounds in the particularly disclosed ratio provides enhanced elastomer compatibility to the fluid.

Published European Patent Application 113,199 published July 11, 1984, discloses a tractor hydraulic fluid which includes oleyl phosphite in a tractor antifriction hydraulic fluid as well as thioethyloctadecenylsuccinate containing tractor hydraulic fluids.

British Patent 1,452,513 dated Oct. 13, 1976, discloses lubricant compositions which include a fatty acid and a fatty acid amide in a wet braking system for tractors which was found to be useful in reducing the amount of noise over a wide temperature range.

British Patent 1,440,261 discloses a composition for reducing the noise in the wet braking systems of tractors. The fluid was comprised of a lubricant oil, and a detergent or dispersant mixed with stearic acid. The composition indicated that it also included alkylene polyamine dispersants, calcium and barium sulfonates and phenates, antiwear-antioxidants and oleic acid.

SUMMARY OF THE INVENTION

A functional fluid, especially in the form of a tractor fluid, is disclosed which is comprised of a major amount of a hydrocarbon oil and a minor amount, sufficient to improve characteristics (e.g. lubricant ability, power transfer means ability, and heat transfer means ability) of the fluid of an additive. The additive includes four essential ingredients which are each present in an amount sufficient to improve characteristics as indicated above and may include other components to enhance these characteristics or to provide even further desirable characteristics to the fluid. The additive necessarily includes a calcium salt, an EP/antiwear agent in the form of a zinc dithiophosphate salt, a borated epoxide and a carboxylic solubilizer preferably in the form of a amine reaction product of a acylating agent containing a substituted hydrocarbyl-base substituent containing about 12 to 500 carbon atoms. Specific amounts and ranges with respect to the additive and the four essential components are described below. However, since the additive may be used in a number of different types of fluids, these amounts might vary and might also vary somewhat due to other components and their amounts.

The inventors have found that although there is some flexibility with respect to the amounts of each of these four essential components which must be present and the precise definition of each of these four components as generically described above, a useful functional fluid cannot be obtained if the amount limitations are completely ignored or if other components are randomly substituted for these four essential ingredients.

A primary object of this invention is to provide a functional fluid possessing a wide variety of different functional characteristics especially when used as a tractor fluid.

Another object of this invention is to provide a functional fluid capable of passing a wide variety of different tests with respect to characteristics such as EP/antiwear characteristics, water tolerance, brake capacity and chatter and filterability.

Still another object of the invention is to simultaneously provide improved performance in the areas of improved low temperature fluidity/filterability, EP/antiwear performance, friction improving properties, wet brake chatter suppression, and capacity with respect to actuating hydraulics, transmissions, power steering and braking without harming performance in other areas.

Yet another object is to increase performance with respect to EP/antiwear performance without having an undesirable effect on corrosion testing and transmission performance.

Still another object is to provide improved water tolerance by including surfactants while not limiting EP performance.

Other objects of this invention include providing a functional fluid capable of passing a wide variety of different tests with respect to characteristics such as frictional characteristics, low temperature fluidity, seal swell characteristics, antifoaming characteristics, antioxidation characteristics and EP protection as demonstrated by spiral bevel and straight spur gear testing.

Another object is to provide sufficient power steering performance while simultaneously providing sufficient transmission performance as demonstrated in Turbo Hydra-matic oxidation testing (a General Motor Corp. test).

Another object is to provide a fluid which provides sufficient friction retention for power shift transmission clutches and provides corrosion inhibition particularly with respect to yellow metal (i.e. copper, brass, bronze) corrosion while simultaneously providing improved EP performance, proper frictional properties for wet brake chatter suppression and simultaneously providing wet brake capacity and power take/off clutch performance.

A primary object of this invention is to provide a functional fluid which includes its essential components such that the fluid simultaneously provides a variety of desirable characteristics.

These and other objects of the invention will become apparent to those skilled in the art upon reading this disclosure.

DETAILED DESCRIPTION OF THE INVENTION

The present invention may be produced and sold in the form of the functional fluid final product which can be included in various mechanical devices such as tractors. However, the invention is generally produced in the form of a concentrate which is then substantially diluted within a hydrocarbon oil to form the final fluid. The concentrate itself is made up of various components which are themselves often contained within an oil of some type, i.e., a diluent or "dil" oil. This should be kept in mind with respect to the percentage parts by weight of the components present within the functional fluid. The parts by weight mentioned with respect to the amount of each of the components present within the functional fluid is the parts by weight of the active chemical, and not that component as it might be added in combination with its "dil" oil.

The four essential components of the present functional fluid are: (1) calcium salt; (2) antiwear agent in the form of a group II metal dithiophosphate salt; (3) borated epoxide; (4) carboxylic solubilizer. Each of these four components as well as other components which are preferably present in the functional fluid of the invention will now be described in detail. It should be pointed out that none of these components themselves are per se novel compounds. However, the presence of these compounds in combination with each other does provide a novel functional fluid which provides improved characteristics not before obtainable.

A variety of different types of metal salts have been disclosed and have been indicated as being especially valuable due to their detergent or dispersant properties and their ability to neutralize undesirable acid bodies formed in lubricants during the operation of the engine or device in which the lubricant is included. Such metal salts are generally in the form of overbased and/or neutral complexes with high molecular weight aliphatic carboxylic acids, sulfonic acids, anhydrides, esters, amides, imides or salts. These overbased complexes may be used as additives in lubricating oils, gasoline or other organic materials.

Overbased complexes in general are disclosed within U.S. Pat. No. 3,714,042 which is incorporated herein by reference for purposes of disclosing calcium salts and calcium salt complexes which might be used in connection with the present invention. The present inventors have found that although numerous other types of metal salts and metal salt complexes are generally used in the art, only calcium salts and calcium salt complexes provide the desirable characteristics of the functional fluid of the present invention. Further, it has now been found that it is preferable to include overbased and/or neutral calcium complexes in the form of overbased and/or neutral calcium sulfonates, overbased and/or neutral calcium sulfonate-carboxylates and overbased calcium carboxylates.

A mixture of overbased carbonated calcium complexes useful in connection with the functional fluid of the present invention can be formed by carbonating an oil soluble sulfonic acid (e.g. sulfonic acids of the type comprising petroleum sulfonates, sulfonated alkyl benzenes, etc.) alone or in combination with a calcium alkyl phenate, a mixture of lower alcohols and an excess of lime. The oil soluble sulfonic acid or mixture of acids and calcium alkyl phenate are overbased by the use of the lime. At this point an overbased carbonated calcium complex has been formed. Such a complex can be used in connection with the present invention. However, it might be desirable to take the solution which has been overbased with lime and then stabilize it by post treating the complex with a polyisobutene substituted succinic anhydride. The overbased calcium complex used in connection with the present invention may be used in combination with other similar compounds, e.g., including calcium sulfonates which are combined with calcium phenates. This component of the invention is likely to contain a mixture of neutral and overbased salt complexes.

The use of the term "complex" refers to basic metal salts which contain metal in an amount in excess of that present in a neutral or normal metal salt. The "metal ratio" characterizing a complex is thus the ratio of the total equivalents of metal to the equivalents of metal in the form of neutral or normal metal. The "base number" of the complex is the number of milligrams of KOH to which one gram of the complex is equivalent as measured by titration.

The "base number" of the calcium complexes used in connection with the present invention varies over a range of from about 0 to about 500 TBN. As such complex is present within a diluent oil, the base number of the calcium complex is preferably in the range of from about 200 to about 400 and more preferably about 300.

In the present invention, the metal salt complex must include some calcium metal salt complex. However, there may also be present other metal salt complexes and there may be present calcium salts which are not "overbased."

A useful calcium complex for use in connection with the present invention could be prepared by the following procedure:

To 950 grams of a solution of a basic, carbonated calcium salt of an alkylated benzene sulfonic acid (average molecular weight 385) in mineral oil (base number about 300, calcium—12.0 percent and sulfur—1.4 percent) there is added 50 grams polyisobutene (molecular weight 1000)—substituted succinic anhydride post treatment (having a saponification number of 100) at 25° C. Mixture is stirred for 0.65 hours at 55°-57° C. and then at 152°-153° C. for 0.5 hours and filtered at 150° C. The filtrate has a base number of about 300 and contains 53 percent of mineral oil.

The calcium salts complexes preferable used in connection with the present invention are useful in providing improved characteristics in areas such as dispersancy and antirust and as used in a tractor fluid is present in an amount of about 0.5 to about 5.5 parts by weight based on the weight of the fluid.

The EP/antiwear agent used in connection with the present invention is in the form of a zinc dithiophosphate. Although there are an extremely large number of different types of antiwear agents which might be utilized in connection with such functional fluids, the present inventors have found that zinc dithiophosphate type antiwear agents work particularly well in connection with the other components to obtain the desired characteristics. Particularly useful zinc dithiophosphate antiwear agents are disclosed within U.S. Pat. No. 4,263,150 which is incorporated herein by reference for the purposes of disclosing preferred zinc dithiophosphates.

It has been found that salts of dialkylphosphorodithioic acids which are treated with phosphites and/or olefins work particularly well in connection with the present invention. More specifically, treating such salts or their acid precursors with a triaryl phosphite, and specifically, triphenyl phosphite, provide results which work particularly well in connection with the functional fluid and particularly the tractor fluid of the present invention. By treating these zinc salts or their acid precursors with triaryl phosphite compounds, the treated zinc salts have a reduced tendency to stain and corrode the metal parts that they are used in connection with. Specifically, such treated zinc salts or acid precursors are much less likely to stain or corrode copper parts.

The salts of dialkylphosphorodithioic acids are known to be useful with respect to their antiwear properties as used within lubricating compositions. However, the antiwear agents used in connection with the present invention have removed the sulfur activity of such zinc salts by some means. One means for removing the sulfur activity involves treating the salt or their acid precursors with phosphites. For example, an antiwear agent useful in connection with the present invention can be prepared by the following method:

Triphenylphosphite is heated with a zinc dialkylphosphorodithioate or a mixed zinc salt of a dialkylphosphorodithioic acid and a carboxylic acid. The dialkylphosphorodithioic acid used in the preparation of the zinc salt is itself prepared by the reaction of at least one alcohol with phosphorus pentasulfide which contains a stoichiometric excess of sulfur.

The zinc dithiophosphate component of the present invention is added in an amount sufficient to improve antiwear properties of the fluid and as used in a tractor fluid is present in an amount of about 1 percent to about 4 percent by weight based on the weight of the fluid.

Various boron containing compounds are known to be useful in connection with functional fluids. It has now been found that borated epoxides work particularly well in combination with the other components described herein to provide a functional fluid with improved characteristics. Such borated epoxides are obtained by reacting an epoxide of the general structural formula:

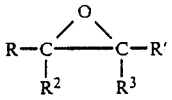

wherein R, R', $R^2$ and $R^3$ are hydrogen or a $C_{8-30}$ hydrocarbyl group, at least one of which is hydrocarbyl, with boric acid, boric oxide or an alkyl borate of the formula $(RO)_xB(OH)_y$ wherein x is 1 to 3 and y is 0 to 2, there sum being 3, or boric oxide and R is an alkyl group containing 1 to 6 carbon atoms. Such borated epoxide compounds are disclosed within U.S. Pat. No. 4,410,438 incorporated herein by reference for purposes of disclosing the borated epoxide component used in connection with the present functional fluid.

One preferred borated epoxide is obtained as the result of reacting boric acid with a 1,2-epoxide mixture with the epoxide containing about 16 carbon atoms.

It is possible to prepare a borated epoxide useful in connection with the present invention by including 1,2-epoxide hexadecane in combination with boric acid. The mixture is heated to about 180° C. in the presence of water and toluene. The reaction may be carried out in the presence of a diluent oil. The resulting product is a borated epoxide compound which is useful in connection with the functional fluid of the present invention.

The borated epoxide is present in an amount sufficient to provide the fluid with an ability to pass fluid related tests and for a tractor fluid is present in an amount of about 0.1 percent to about 1.5 percent by weight based on the weight of the fluid.

The fourth essential component of the present functional fluid is a carboxylic solubilizer. This component is capable of interacting with other components in such a manner so as to provide a microemulsion of water particles so as to provide improved water tolerance and filterability. The carboxylic solubilizer component is present in sufficient amount so as to provide these characteristics, i.e., improved water tolerance and filterability, and for a tractor fluid is about 0.1 percent to about 1 percent by weight based on the weight of the fluid.

Preferred examples of such carboxylic solubilizers are disclosed within U.S. Pat. No. 4,435,297 which is incorporated herein by reference for purposes of disclosing carboxylic solubilizers useful in connection with the present functional fluid.

The carboxylic solubilizers used in connection with the present functional fluid are nitrogen-containing phosphorus-free carboxylic acid derivatives. These derivatives are made by reacting an acylating agent with an alkanol tertiary monoamine. It has now been found that particular solubilizing agents work particularly well in connection with functional fluids and especially those functional fluids useful as tractor fluids. The most preferred carboxylic solubilizer found by the inventor is the product of a reaction of polybutylene succinic anhydride with N,N-diethylethanolamine at a molar ratio of 1:2. The resulting product is predominantly an ester-salt and contains a small amount of diester. Further, the product may contain small amounts of free unreacted polybutylene and trace amounts of maleic anhydride reacted with N,N-diethylethanolamine.

The carboxylic solubilizer most preferably used in connection with the present invention is a nitrogen-containing, phosphorous-free carboxylic acid derivative which is obtained by the reaction at a temperature in the range of about 30° C. to the decomposition temperature of one or more of the reacting components of (A) a carboxylic acid acylating agent with (B) an alkanol tertiary monoamine. The acylating agent has at least one hydrocarbyl substitutent containing about 20 to about 500 carbon atoms and the monoamine (B) has one hydroxyl group and a total of up to about 40 carbon atoms.

In addition to the four essential components described above, the present functional fluid preferably includes a viscosity improving agent and an antifoaming agent. The type and amount of each component is adjusted depending on factors such as the temperature of operation, the desired viscosity and amount of aggitation the fluid is subjected to and the amount of foaming permitted. Since a functional fluid is likely to be utilized in equipment over a wide temperature range, the inclusion of the viscosity improving agent in order to aid in the regulation of the viscosity of the fluid is highly desirable. The viscosity improver is generally present in an amount of about 0.5 to about 8 percent by weight based on the weight of the fluid. Further, since the fluid is generally subjected to substantial mechanical agitation and pressure, the inclusion of an antifoaming agent is highly desirable in order to reduce and/or eliminate foaming which could create problems with the mechanical operation of the device the fluid is used in connection with. The antifoaming agent is generally present in an amount of about 0.005 to about 0.08 parts by weight based on the weight of the fluid.

Some useful viscosity index improvers include well-known polymethacrylate compounds, hydrogenated styrene-butydiene viscosity improvers and styrene-malan copolymers. A useful antifoaming agent includes a combination of about 90 percent by weight of kerosene and about 10 percent by weight of a silicone agent (DC 200, VIS 30,000 cSt at 25° C.).

The functional fluid of the present invention can be in the form of various specific types of functional fluids such as hydraulic/transmission fluids, brake fluids, power steering fluids and tractor fluids, the precise composition of which might vary slightly. The precise composition of such fluids can be formulated by those skilled in the art upon reading the present disclosure and considering the characteristics of the fluid which are effected by the components and the amount ranges disclosed. In order to provide the present invention in the form of a final product it is necessary to include the four essential components within a hydrocarbon oil. The four essential components in the form of active chemicals are present within the hydrocarbon oil in an amount in the range of about 0.5 percent to about 19.5 percent by weight based on the total weight of the functional fluid of the invention. Accordingly, the hydrocarbon oil is present in the amount in the range of about 81.5 percent to about 99.5 percent based on the total weight of the functional fluid.

The four essential components of the present invention could be included by themselves or in combination with other components within a concentrate. The concentrate could contain from about 1 percent to about 99 weight percent of the active chemical with the remainder of the concentrate being comprised of a hydrocarbon oil.

When formulating a tractor fluid the hydrocarbon oil is generally present in an amount in the range of about 81.5 weight percent to about 99.5 weight percent. The individual essential components of the tractor fluid are present in the following amounts: the calcium salt is present in an amount of about 0.5 weight percent to about 5.5 weight percent; the EP/antiwear agent is present in an amount of about 1 percent to about 4 weight percent; the borated epoxide is present in amount of about 0.1 percent to about 1.5 weight percent and the carboxylic solubilizer is present in the amount of about 0.1 percent to about 1 weight percent, with all of the amounts being based on parts by weight of the active chemical in the tractor fluid as a whole.

In a particularly preferred embodiment of the present invention the calcium salt is present in an amount of about 1.41 weight percent or about 3 percent with its diluent oil. The EP/antiwear agent is present in an amount of about 1.7 weight percent; the borated epoxide is present in an amount of about 0.5 weight percent and the carboxylic solubilizer is present in an amount of about 0.25 weight percent of active chemical based on the weight of the tractor fluid as a whole.

EXAMPLE I

A formulation containing 2.82 percent by weight of an overbased calcium sulfonate salt complex; 3.38 percent by weight of a zinc dithiophosphate; 1 percent by weight of a borated epoxide and 0.5 percent by weight of a carboxylic solubilizer; 1.93 percent by weight of styrene/maleic anhydride VI improver and 0.02 percent by weight of a silicon anti-foam agent dissolved in hydrocarbon oil.

EXAMPLE II

A formulation containing 1.76 percent by weight of an overbased calcium sulfonate salt complex; 2.14 percent by weight of a zinc dithiophosphate treated with triphenylphosphite; 0.63 percent by weight of a borated epoxide and 0.31 percent by weight of a carboxylic solubilizer as the essential components and including 1.93 percent by weight of a styrene/maleic anhydride VI improver; and 0.02 percent by weight of a silicon anti-foam agent dissolved in hydrocarbon oil.

EXAMPLE III

A formulation containing 1.41 percent by weight of an overbased calcium sulfonate salt complex; 1.71 percent by weight of a zinc dithiophosphate treated with an olefin; 0.5 percent by weight of a borated epoxide and 0.25 percent by weight of a carboxylic solubilizer as the essential components and 1.93 percent by weight of a styrene/maleic anhydride VI improver; and 0.02 percent by weight of a silicon anti-foaming agent dissolved in hydrocarbon oil.

With respect to each of the examples referred to above some variation is possible with respect to what each of the actual components will be. For example, with respect to the use of an overbased calcium sulfonate salt complex, the actual component utilized might be a calcium sulfonate complex which has been overbased with a calcium compound and then treated with polyisobutylene succinic acid or anhydride having a molecular weight in the range of from about 700 to about 5,000. With respect to the zinc dithiophosphate this component might be a mixture of zinc salts of bis(2-ethylhexyl)dithiophosphate and 2-ethylhexyl carboxylic acid treated with triphenylphosphite. This salt is preferably combined with a stoichiometric excess of zinc, i.e., the salt is preferably over-zinced including about 1.2 to about 1.4 stoichiometric equivalents of zinc. The borated epoxide may be a product obtained as a result of the reaction of boric acid with 1,2-epoxide containing about 16 carbon atoms. The carboxylic solubilizer may be the product obtained as a result of a reaction of polybutenyl succinic anhydride with N,N-diethylethanolamine at a molar ratio of about 1:2. In addition, these formulations may include other components depending upon its desired end use. The actual specific chemical compound used for each of the essential components, their amounts, as well as other additional active chemicals will be chosen by those skilled in the art depending upon the specific requirements of the functional fluid being produced. Variations in the amounts and the actual specific type of chemical component will be deducible by those of ordinary skill in the art upon consideration of their needs and a reading of the present description.

The present invention has been disclosed and described here in what is believed to be its most preferred embodiments. However, it is recognized that those skilled in the art, upon reading this disclosure, will recognize certain variations thereof which are considered to be encompassed by the scope of the present invention.

What is claimed is:

1. A functional fluid comprising:

from about 88 to about 98.3 percent by weight based on the total weight of the functional fluid of a hydrocarbon oil and from about 1.7 to about 12 percent by weight based on the total weight of the functional fluid of an additive comprising:

from about 0.5 to about 5.5 weight percent of a calcium salt in the form of a calcium sulfonate complex which has been overbased with a calcium compound;

from about 1 to about 4 weight percent of an EP/antiwear agent in the form of a zinc salt of a dialkylphosphorodithioic acid treated with triphenylphosphite;

from about 0.1 to about 1.5 weight percent of a borated epoxide; and from about 0.1 to about 1 weight percent of a carboxylic solubilizer in the form of an ester-salt reaction product of an acylating agent containing a substituted hydrocarbyl-based substituent containing about 12 to about 500 carbon atoms and an alkanol tertiary monoamine.

2. A functional fluid comprising:

from about 88 to about 98.3 percent by weight based on the total weight of the functional fluid of a hydrocarbon oil and from about 1.7 to about 12 percent by weight based on the total weight of the functional fluid of an additive comprising:

from about 0.5 to about 5.5 weight percent of a calcium sulfonate salt complex which has been overbased with a calcium compound and then treated with polyisobytylene succinic acid or anhydride having a molecular weight in the range of from about 700 to about 5,000;

from about 1 to about 4 weight percent of an EP/antiwear agent in the form of a zinc salt of a dialkylphosphorodithioic acid treated with triphenylphosphite;

from about 0.1 to about 1.5 weight percent of a borated epoxide; and from about 0.1 to about 1 weight percent of an ester-salt carboxylic solubilizer in the form of an ester-salt reaction product of an acylating agent containing a substituted hydrocarbyl-based substituent containing about 12 to about 500 carbon atoms and an alkanol tertiary monoamine.

3. The functional fluid as claimed in claim 1, wherein the overbased calcium salt complex is then treated with polyisobutylene succinic acid or anhydride having a molecular weight in the range of from about 700 to about 5,000.

4. The functional fluid as claimed in claim 1, wherein the EP/antiwear agent is in the form of a mixture of zinc salts of bis(2-ethylhexyl) dithiophosphate and 2-ethylhexanoic acid treated with triphenylphosphite.

5. The functional fluid as claimed in claim 1, wherein the borated epoxide is obtained as a result of the reaction of boric acid with a 1,2-epoxide containing about 16 carbon atoms.

6. The functional fluid as claimed in claim 1, wherein the carboxylic solubilizer is obtained as the reaction product of polybutenyl succinic anhydride with N,N-diethylethanolamine at a molar ratio of about 1:2.

7. A functional fluid comprising:

from about 88 to about 98.3 percent by weight based on the total weight of the functional fluid of a hydrocarbon oil and from about 1.7 to about 12 percent by weight based on the total weight of the functional fluid of an additive comprising:

from about 0.5 to about 5.5 weight percent of a calcium sulfonate salt complex which has been overbased with a calcium compound and then treated with polyisobytylene succinic acid or anhydride having a molecular weight in the range of from about 700 to about 5,000;

from about 1 to about 4 weight percent of an EP/antiwear agent in the form of a mixture of zinc salts of bis(2-ethylhexyl)dithiophosphate and 2-ethylhexanoic acid treated with triphenylphosphite;

from about 0.1 to about 1 weight percent of a borated epoxide obtained as a reaction product of boric acid with 1,2-epoxide containing about 16 carbon atoms; and from about 0.1 to about 1 weight percent of a carboxylic solubilizer obtained as a reaction product of about 12 to about 500 carbon atom polybutenyl substituted succinic anhydride with N,N-diethylethanolamine at a molar ratio of about 1:2.

8. The fluid as claimed in any one of claims 1, 2, 5 or 6 wherein the additive further comprises of an antifoaming agent and a viscosity improver.

9. A hydraulic/transmission fluid, comprising:

about 88 percent to about 98.3 percent of a hydrocarbon oil and about 1.7 percent to about 12 percent of an additive comprising:

from about 0.5 to about 5.5 weight percent of an overbased calcium sulfonate complex;

from about 1 to about 4 weight percent of an antiwear agent in the form of a zinc salt of a dialkylphosphorodithioic acid treated with triphenylphosphite;

from about 0.1 to about 1.5 weight percent of a borated epoxide; and from about 0.1 to about 1 weight percent of a carboxylic solubilizer in the form of an ester-salt reaction product of an acylating agent containing a substituted hydrocarbyl-based substituent containing about 12 to about 500 carbon atoms on an alkanol tertiary monoamine.

10. A hydraulic/transmission fluid, comprising:

about 88 percent to about 98.3 percent of a hydrocarbon oil and about 1.7 percent to about 12 percent of an additive comprising:

from about 0.5 to about 5.5 weight percent of a calcium sulfonate salt complex which has been overbased with a calcium compounds;

from about 1 to about 4 weight percent of an antiwear agent in the form of a mixture of zinc salts of dialkylphosphorodithioic acids treated with triphenylphosphite;

from about 0.1 to about 1.5 weight percent for a borated epoxide; and from about 0.1 to about 1 weight percent of a carboxylic solubilizer in the form of an ester-salt reaction product of about 12 to about 500 carbon atom substituted succinic anhydric and a N-(hydroxylsubstituted hydrocarbyl) tertiary monoamine.

11. The hydraulic/transmission fluid as claimed in claim 10, wherein the overbased calcium sulfonate complex is then treated with polyisobutylene succinic acid or anhydride having a molecular weight in the range of from about 700 to about 5,000 and wherein the fluid is further comprised of a viscosity improver and an antifoaming agent.

* * * * *